US012163254B2

(12) United States Patent
Haynes et al.

(10) Patent No.: US 12,163,254 B2
(45) Date of Patent: Dec. 10, 2024

(54) FIBER FORMING DEVICE AND PROCESS USING SAME

(71) Applicant: Kimberly-Clark Worldwide, Inc., Neenah, WI (US)

(72) Inventors: Bryan D. Haynes, Jasper, GA (US); Douglas J. Hulslander, Sugar Hill, GA (US); Craig A. Barnes, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/261,510

(22) PCT Filed: Oct. 25, 2021

(86) PCT No.: PCT/US2021/056453

§ 371 (c)(1),
(2) Date: Jul. 14, 2023

(87) PCT Pub. No.: WO2023/075747

PCT Pub. Date: May 4, 2023

(65) Prior Publication Data

US 2024/0117528 A1 Apr. 11, 2024

(51) Int. Cl.
*D01D 4/02* (2006.01)
*D01D 5/098* (2006.01)

(52) U.S. Cl.
CPC ..... *D01D 4/025* (2013.01); *D01D 5/0985* (2013.01)

(58) Field of Classification Search
CPC ..... D01D 4/025; D01D 5/0985; D01D 5/08; D01D 5/0023
See application file for complete search history.

(56) References Cited

U.S. PATENT DOCUMENTS 6,117,379 A * 9/2000 Haynes ..... D04H 3/03 425/464
2015/0322592 A1 11/2015 Brown et al.
2019/0040547 A1* 2/2019 Benjamin ..... D01D 4/025

OTHER PUBLICATIONS

PCT Search Report Corresponding to Application No. PCT/US2021/056453 on Mar. 15, 2022.

* cited by examiner

*Primary Examiner* — S. Behrooz Ghorishi
(74) *Attorney, Agent, or Firm* — Dority & Manning, P.A.

(57) ABSTRACT

A fiber forming device is disclosed that is well suited to producing nonwoven webs having excellent barrier properties. In one aspect, the fiber forming device can be used to produce meltblown webs or coform webs. The fiber forming device includes a die head containing multiple rows of polymer nozzles for forming fibers. Air flow paths are positioned on either side of the rows of polymer nozzles. In addition, an air flow path is positioned in between the rows of polymer nozzles. The air flow paths produce an attenuating gas stream that attenuates fibers being produced by the polymer nozzles and directs the fibers onto a forming surface for forming nonwoven webs.

12 Claims, 7 Drawing Sheets

FIBER FORMING DEVICE AND PROCESS USING SAME

RELATED APPLICATIONS

The present application is the national stage entry of International Patent Application No. PCT/US2021/056453 having a filing date of Oct. 25, 2021, which is incorporated herein in its entirety by reference thereto.

BACKGROUND

One type of web formed from a molten thermoplastic polymer is known as a meltblown web. The fibers are formed by extruding a molten thermoplastic polymeric material through a plurality of small holes. The resulting molten threads or filaments pass into converging high velocity gas streams that attenuate or draw the filaments of molten polymer to reduce their diameters. Thereafter, the meltblown fibers are carried by the high velocity gas stream and deposited on a collecting surface, or forming wire, to form a nonwoven web of randomly dispersed meltblown fibers.

Generally, meltblowing utilizes a specialized apparatus to form the meltblown webs from a polymer. Often, the polymer flows from a die through narrow cylindrical outlets and forms meltblown fibers. The narrow cylindrical outlets may be arranged in a substantially straight line and lie in a plane which is the bisector of a V-shaped die tip. Typically a pair of air plates is positioned proximate the die tip to form two air flow paths therebetween along each face of the die tip. Thus, air may flow through these air flow paths to impinge on the fibers exiting from the die tip, thereby attenuating them.

Exemplary meltblown systems, for instance, are discussed or described in U.S. Pat. Nos. 4,663,220, 6,074,597, 5,902,540, 6,336,801, 6,972,104, and 7,316,552, which are all incorporated herein by reference.

Meltblown webs can be formed with many highly desirable properties. For example, because meltblown webs can be made from relatively small fibers, the webs have excellent barrier properties against various different types of fluids, such as liquids and gases. Consequently, meltblown webs are commonly used to produce all different types of medical protective products, including surgical gowns, wound dressings, facemasks, and the like. A system and method for making meltblown webs with increased barrier and/or filtration properties would be highly desirable.

In particular, a need exists for an improved process and method of producing meltblown webs with excellent barrier and/or filtration properties. More particularly, a need exists for a process and system that can produce meltblown webs with a greater density of fibers and/or produce ultrafine fibers in an efficient manner.

SUMMARY

The present disclosure is generally directed to a fiber forming device particularly well suited to producing nonwoven webs having very fine fibers. Nonwoven webs made from the fibers have excellent barrier and/or filtration properties. The present disclosure is also generally directed to a process for producing nonwoven webs from the fiber forming device.

For example, in one aspect, the present disclosure is directed to a fiber forming device comprising a die head having a length and a width. The die head comprises a first row of polymer nozzles spaced and parallel or substantially parallel with a second row of polymer nozzles. For example, the first row of polymer nozzles can be within ten degrees, five degrees or two degrees of being parallel with the second row of polymer nozzles. The first and second rows of polymer nozzles are configured to receive a flow of a molten polymer material for emitting polymer fibers from the die head. The first and second rows of polymer nozzles extend along the length of the die head.

The die head further contains a first air flow path, a second air flow path, and a third air flow path that are spaced apart and extend along the length of the die head in a parallel or substantially parallel relationship. For example, the air flow paths can be within ten degrees, five degrees or two degrees of being parallel with each other. The first air flow path is positioned between a first outer edge of the die head and the first row of polymer nozzles. The second air flow path is positioned between a second outer edge of the die head and the second row of polymer nozzles. The third air flow path is positioned between the first row of polymer nozzles and the second row of polymer nozzles. The first air flow path includes an outlet that is positioned such that a gas stream flowing out of the outlet converges with a gas stream exiting the third air flow path. Similarly, the second air flow path can include an outlet that is positioned such that a gas stream flowing out of the outlet converges with a gas stream exiting the third air flow path. The first, second and third air flow paths are configured to direct an attenuating gas stream against molten polymer fibers exiting the first row of polymer nozzles and the second row of polymer nozzles. The third air flow path is in communication with a gas flow path that is configured to control fluid flow to the third air flow path independently of fluid flow to the first air flow path and the second air flow path such that a gas can be fed to the third air flow path at a different pressure than gases fed to the first air flow path and to the second air flow path. The first air flow path can also be controlled independently of the second air flow path.

In one aspect, the die head can include a fiber dispensing surface. The first row of polymer nozzles, the second row of polymer nozzles, the first air flow path, the second air flow path, and the third air flow path can all be positioned along the fiber dispensing surface. The fiber dispensing surface can have a V-shape and define an apex. The first and second rows of polymer nozzles can be configured to emit fibers adjacent to the apex of the fiber dispensing surface. In one aspect, the first row of polymer nozzles and the second row of polymer nozzles can each be positioned at an angle towards each other.

Similarly, the first air flow path and the second air flow path can each be positioned at an angle towards each other. The third air flow path can be configured to emit a fluid stream in a generally downward and vertical direction. In one embodiment, the first air flow path and the first row of polymer nozzles are symmetric to the second air flow path and the second row of polymer nozzles with respect to the vertical axis of the die head.

The first, second and third air flow paths can have any suitable shape or configuration for emitting a pressurized gas. For instance, each air flow path runs along the length of the die head, where an air flow path is any structure that permits the flow of a gas from two points along a path, including, for example, channels, slots, apertures, passages, and chambers. In one embodiment, the first air flow path is in communication with a first air chamber, the second air flow path is in communication with a second air chamber, and the third air flow path can be in communication with a third air chamber. Each of the chambers can be isolated from the other chambers and can be used to supply a pressurized gas to the air flow paths. For example, a fluid flow regulator can regulate the flow and/or pressure of a gas being fed to the air chambers for emitting a gas from the air flow paths at a desired pressure and/or velocity. In one embodiment, the gas flow through the third air flow path is controlled independently of the air flow through the first air flow path and the second air flow path.

In one embodiment, the fiber forming device can include more than two rows of parallel polymer nozzles. For example, the fiber forming device can include a third row of polymer nozzles and a fourth air flow path. The fourth air flow path can be positioned between the second row of polymer nozzles and the third row of polymer nozzles. In one embodiment, the gas flow through the fourth air flow path is controlled independently of the air flow through the first, second, and/or third air flow paths.

The fiber forming device of the present disclosure is designed to be operated in order to minimize turbulence in order to produce very fine fibers having small diameters. In one embodiment, the third air flow path can receive a pressurized gas through a pair of air paths that are separated by a wedge-shaped flow control device. The wedge-shaped flow control device is for directing flow of a gas through the third air flow path while preventing turbulence.

The present disclosure is also directed to a process for forming a nonwoven web. The process includes forming at least two parallel rows of fibers from a molten polymeric material. The fibers are contacted with a plurality of gas streams for attenuating the fibers. The gas streams include a first gas stream that impinges on a first row of the fibers from a first side, a second gas stream that impinges on a second row of fibers from a second side and a third gas stream that is directed between and impinges on the first row of fibers and the second row of fibers. The first gas stream is emitted from a first air flow path at a first pressure, the second gas stream is emitted from a second air flow path at a second pressure, and the third gas stream is emitted from a third air flow path at a third pressure. In accordance with the present disclosure, the third pressure is greater than the first pressure and greater than the second pressure during formation and attenuation of the fibers. The process further includes the step of depositing the attenuated fibers onto a forming surface for forming a nonwoven web.

In one embodiment, the third pressure of the third gas stream emitted by the third air flow path is maintained at a pressure ratio to the first pressure of the first fluid stream and/or to the second pressure of the second fluid stream of from about 1.05:1 to about 2:1, such as from about 1.08:1 to about 1.5:1, such as from about 1.1:1 to about 1.3:1.

In general, any suitable thermoplastic polymer can be used to form the fibers. For example, in one embodiment, the fibers are formed from a polyolefin polymer, such as a polypropylene polymer. Alternatively, the fibers can be formed from a biodegradable polymer and/or a bio-based polymer. The biodegradable polymer, for instance, can be a polylactic acid polymer or a polyhydroxyalkanoate polymer, such as a polyhydroxybutyrate.

In one embodiment, the process can further include the step of contacting the fibers in a molten state with an absorbent material, such as a pulp material, for forming a coform web.

During production of the fibers, the gas pressure exiting the first air flow path, the gas pressure exiting the second air flow path and the gas pressure exiting the third air flow path can be relatively low in order to prevent turbulence. For instance, the gas pressure can be less than about 10 psi, such as less than about 7 psi, such as less than about 5 psi, such as less than about 4 psi. The gas pressure is generally greater than about 0.5 psi. The fibers that are formed during the process can have a diameter of less than about 5 microns, such as less than about 4 microns, such as less than about 3 microns.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
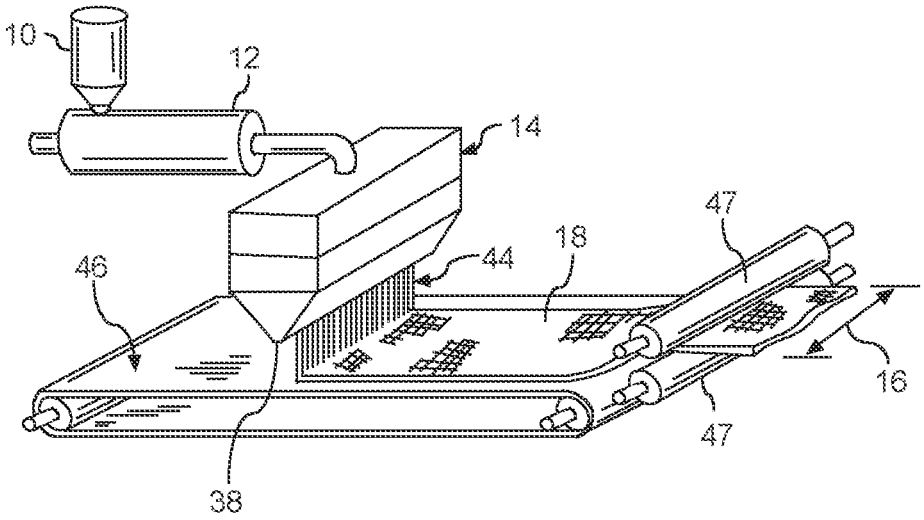
FIG. 1 is a perspective view of one embodiment of a system and process for producing nonwoven webs that may incorporate a fiber forming device in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a fiber forming device and to a method of forming nonwoven webs using the device. The fiber forming device of the present disclosure is particularly well suited to producing very fine fibers having diameters of less than about 5 microns, such as less than about 3 microns for producing nonwoven webs having excellent barrier properties. The fiber forming device, for instance, can be used to produce meltblown fibers for producing meltblown webs.

In the past, conventional meltblown dies included a single row of capillaries located along the apex of a wedge-shaped die tip. The present disclosure is directed to an improved meltblowing apparatus that is more robust and capable of producing meltblown webs having a greater range of properties. Although the meltblowing apparatus of the present disclosure can be used to produce fibers with larger diameters, the apparatus is particularly well suited to producing very fine fibers in order to produce products that have improved barrier and/or filtration properties. In order to produce nonwoven webs according to the present disclosure, the fiber forming device of the present disclosure includes a greater number and a greater density of capillaries or polymer nozzles that are used to form the fibers. Creating a higher density of polymer nozzles enables production of finer fibers while still maintaining a relatively high throughput such that webs can be made using the fiber forming device of the present disclosure without any significant reduction in processing speeds compared to conventional meltblown equipment.

As will be described in greater detail below, the fiber forming device of the present disclosure, instead of including only a single row of polymer nozzles for producing fibers, includes at least two rows of polymer nozzles that are separated by at least one air flow path that feeds a pressurized gas in between the rows of fibers being produced in order to attenuate the fibers and also direct the fibers onto a moving forming surface. In one aspect, the pressure or velocity of the inner gas stream fed between the two rows of fibers is controlled in relation to outer gas streams that contact the opposite side of the fibers for minimizing turbulence when the at least three gas streams converge. Thus, one aspect of the present disclosure is independently controlling the gas pressure or velocity of the inner gas stream compared to the outer gas streams for producing webs not only with excellent mechanical properties but also with uniform properties.

Referring to FIG. 1, one embodiment of a system and process for producing nonwoven webs in accordance with the present disclosure is shown. The system illustrated in FIG. 1 includes a fiber forming device 14 made in accordance with the present disclosure and illustrated in greater detail in FIGS. 2 through 6. As shown in FIG. 1, a hopper 10 provides a polymer material to an extruder 12 attached to the fiber forming device 14 that extends across the width 16 of a nonwoven web 18 to be formed by the meltblowing process. Pressurized gas is fed to the fiber forming device to attenuate the fibers as they are formed.

The extruded fibers 44 exit polymer nozzles or die tips of the fiber forming device 14 and form a coherent and cohesive fibrous nonwoven web 18 on forming surface 46 that may be removed by rollers 47 which may be designed to press the web 18 together to improve the integrity of the web. Thereafter, the web 18 may be transported by conventional arrangement to a windup roll and further processed or incorporated into various articles.

Nonwoven webs made according to the present disclosure can be used in numerous and diverse applications. For instance, due to the excellent barrier and/or filtration properties of the webs, the webs are particularly well suited for use in producing medical products, such as surgical drapes, facemasks, and other protective clothing. The nonwoven webs are also well suited for use in absorbent articles, such as diapers, training pants, feminine hygiene products, wound dressings, and the like. In one aspect, the nonwoven webs of the present disclosure are incorporated into laminates that are then used to make various products. For instance, meltblown webs made according to the present disclosure can be combined with one or more spunbond webs. In one particular application, meltblown webs made according to the present disclosure can be placed between two spunbond webs for producing various articles.

Figure 2:
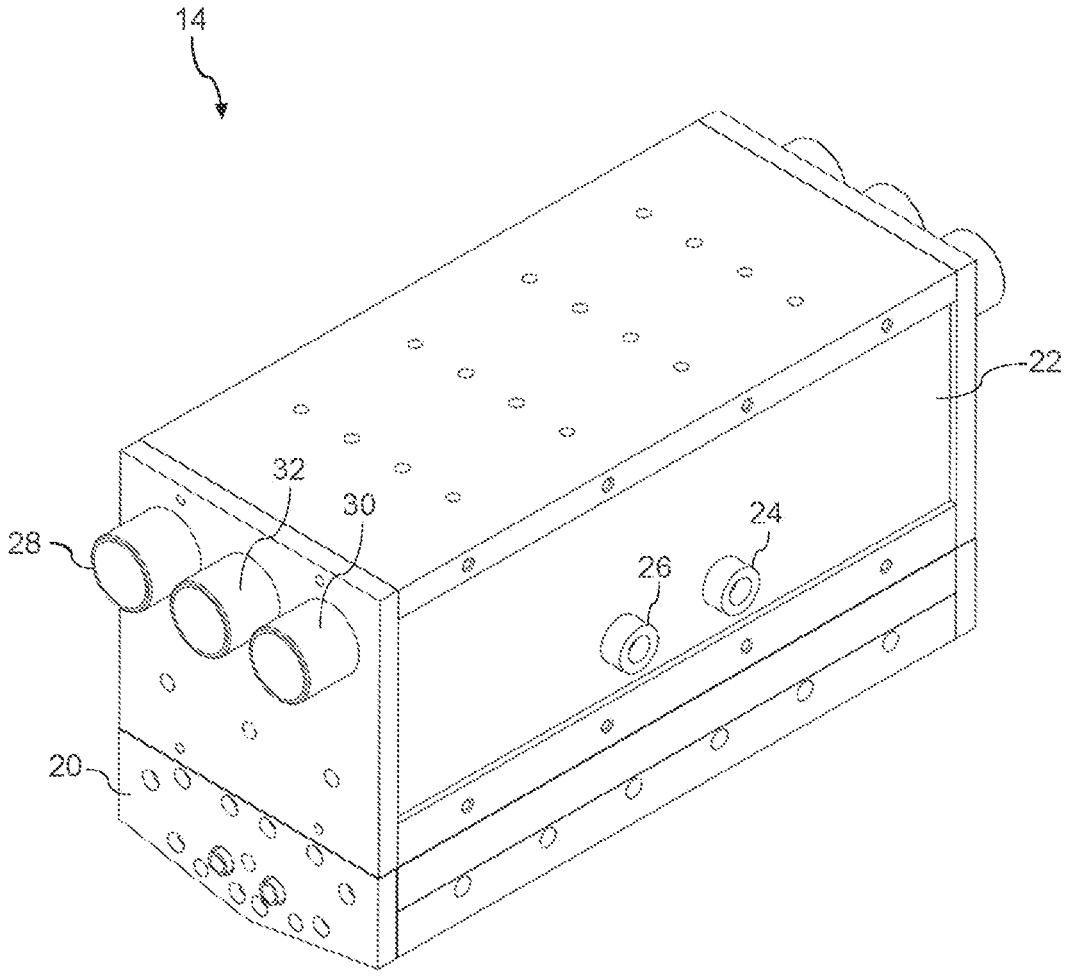
FIG. 2 is a perspective view of one embodiment of a fiber forming device in accordance with the present disclosure.
Figure 3:
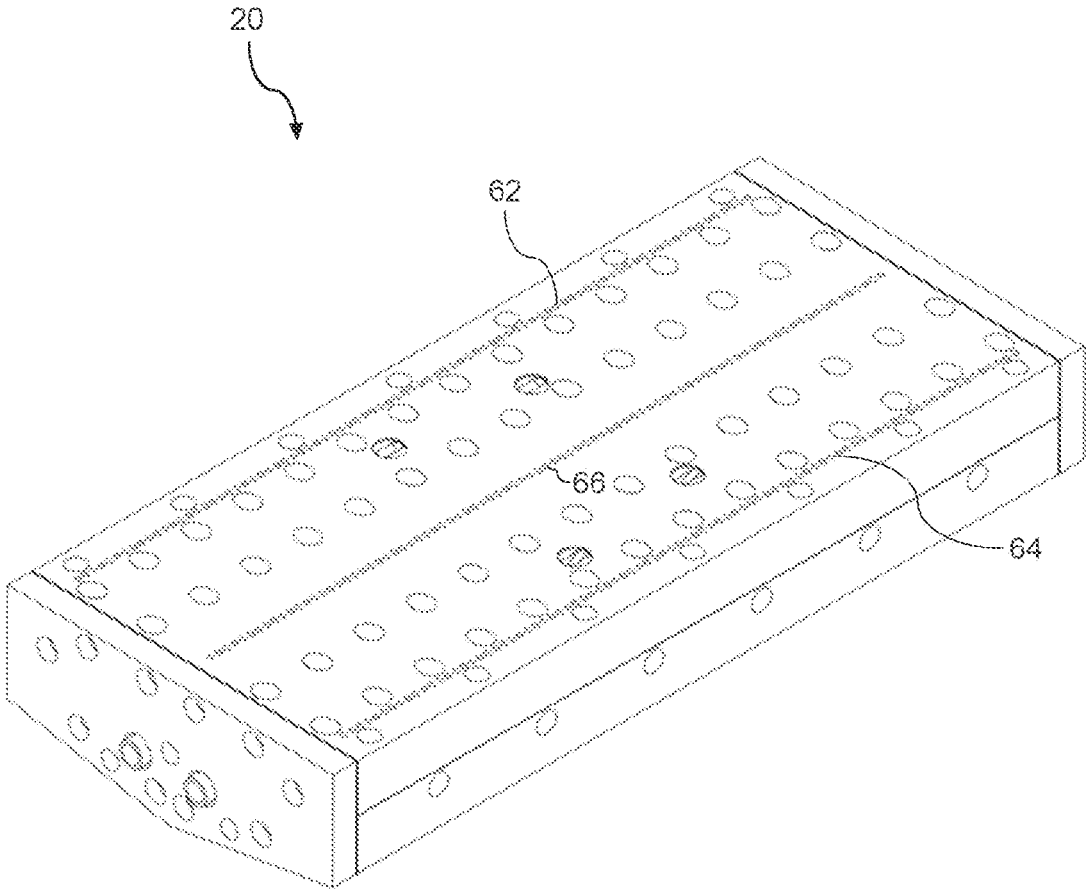
FIG. 3 is a perspective view of a die head that is part of the fiber forming device illustrated in FIG. 1.
Figure 4:
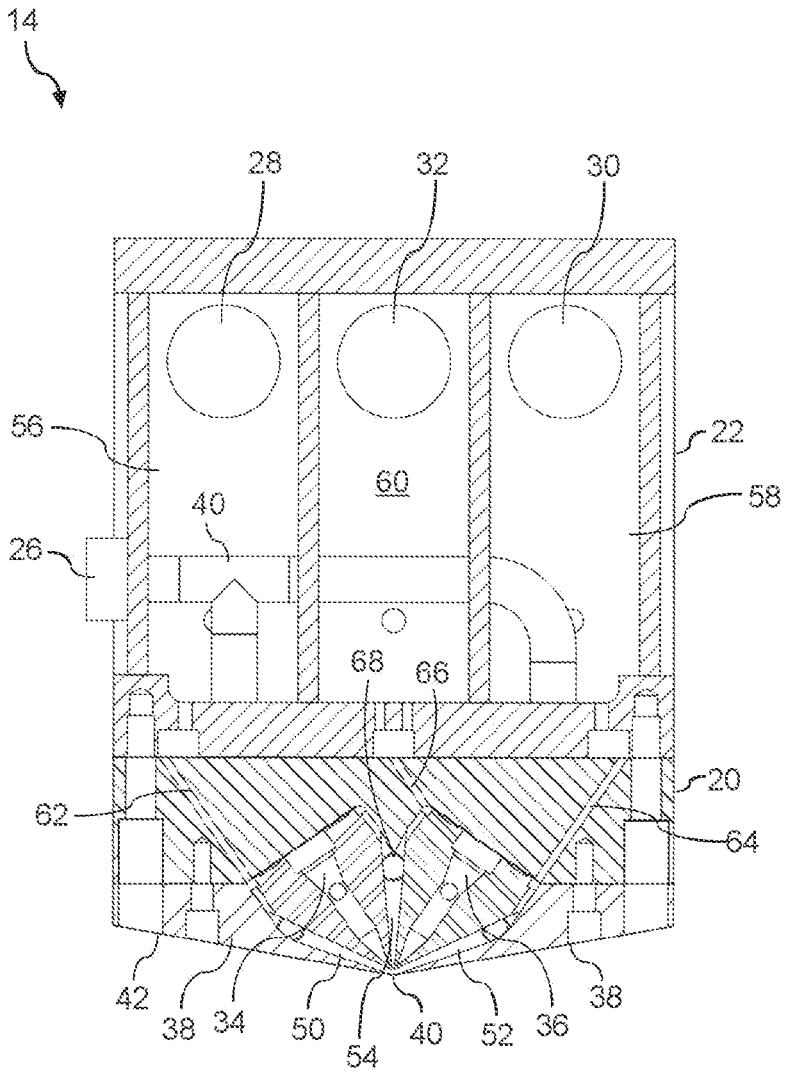
FIG. 4 is a cross-sectional view of the fiber forming device illustrated in FIG. 2.

Referring to FIGS. 2 through 6, the fiber forming device 14 of the present disclosure is shown in greater detail. Referring to FIGS. 2 through 4, the fiber forming device 14 includes a die head 20 that is mounted to a flow head 22 and particularly shown in FIG. 3. The flow head 22 is designed to feed a molten polymer material to the die head 20 and to feed pressurized gases to the die head 20. For example, as shown in FIG. 2, the flow head 22 includes polymer ports 24 and 26 that are designed to connect with an extruder. In the embodiment illustrated in FIG. 1, for instance, the extruder 12 is connected along a top surface of the flow control device 14. In the embodiment illustrated in FIG. 2, however, the flow control device 14 is designed to connect with one or more extruders along a side of the flow head 22.

The flow head 22 as shown in FIG. 2 further defines gas ports 28, 30 and 32. The gas ports 28, 30 and 32 are for connecting to a pressurized gas supply, such as a heated air supply. The gas ports 28, 30 and 32 are for feeding gases to the die head 20 that are then used to attenuate polymer fibers being produced and to direct the fibers onto a forming surface 46, as shown in FIG. 1.

Referring to FIG. 4, a cross-sectional view of the fiber forming device 14 is shown. In accordance with the present disclosure, the die head 20 includes a first row of polymer nozzles 34 spaced from a second row of polymer nozzles 36. In FIG. 4, two representative polymer nozzles 34 and 36 are shown. The row of nozzles 34 and 36 extend along the length of the die head 20. As shown more clearly in FIG. 4, the polymer port 26 includes a molten polymer flow path 40 that divides into two separate flow pathways for supplying molten polymer material to the first row of polymer nozzles 34 and to the second row of polymer nozzles 36.

The die head 20 can include air plates 38 that form a fiber dispensing surface 42. The pair of air plates 38 serve to form air flow paths. In the embodiment illustrated, the fiber dispensing surface 42 has a V-shape that includes an apex 40. The first row of polymer nozzles 34 and the second row of polymer nozzles 36 are positioned adjacent to the apex 40 and can be parallel or substantially parallel with each other and parallel or substantially parallel to the apex 40. In the embodiment illustrated, the polymer nozzles 34 and 36 are positioned in an angular relationship such that the polymer nozzles 34 and 36 are angled towards each other and towards the apex 40.

In addition to the two rows of polymer nozzles 34 and 36, the die head 20 includes a first air flow path 50 positioned on one side of the first row of polymer nozzles 34, a second air flow path 52 positioned on an opposite side of the second row of polymer nozzles 36 and a third air flow path 54 that is positioned between the first row of polymer nozzles 34 and the second row of polymer nozzles 36. The air flow paths 50, 52 and 54 are supplied with a pressurized gas to produce three gas streams that converge and contact fibers being formed by the polymer nozzles 34 and 36. The third air flow path 54 positioned between the first row of polymer nozzles 34 and the second row of polymer nozzles 36 further serves to prevent the two rows of fibers from contacting each other prematurely while the thermoplastic polymer is in a molten state and prior to contacting the forming surface 46.

As shown in FIG. 4, the flow head 22 of the fiber forming device 14 includes separate air chambers. In this embodiment, for instance, the flow head 22 includes a first air chamber 56, a second air chamber 58, and a third air chamber 60. The first air chamber 56 is designed to supply a pressurized gas to (and, in some embodiments, can be part of) the first air flow path 50. The second air chamber 58 is designed to supply a pressurized gas to (and, in some embodiments, can be part of) the second air flow path 52. Similarly, the third air chamber 60 is designed to supply a pressurized gas to (and, in some embodiments, can be part of) the third air flow path 54. More particularly, as shown in FIGS. 3 and 4, the flow head 22 cooperates with the die head 20 for feeding pressurized gases to the different air flow paths. For instance, the die head 20 can include a first air path 62 that is in fluid communication with the first air flow path 50, a second air path 64 that is fluid communication with the second air flow path 52, and a third air path 66 that is in fluid communication with the third air flow path 54. In this manner, pressurized gases can be independently fed to each of the air flow paths 50, 52 and 54. Thus, the fiber forming device 14 provides independent control of gas pressure and gas velocity of gas streams exiting the three different air flow paths 50, 52 and 54. Consequently, gas streams being emitted by the die head 20 can be controlled and adjusted for ensuring that the fibers are attenuated a desired amount and for preventing gas turbulence from occurring when the different gas streams converge. Turbulence, for instance, can cause the fibers to agglomerate and stick together prior to contacting the forming surface.

In order to feed a gas to the fiber forming device 14, the gas ports 28, 30 and 32 can be placed in communication with a single pressurized gas source or a plurality of pressurized gas sources. For instance, each gas port 28, 30 and 32 can be connected to a separate pressurized gas source. A fluid flow regulator can then be placed in the system for controlling the gas pressure within the air flow paths 50, 52 and 54. In one embodiment, each air flow path can be in communication with a separate fluid flow regulator. Alternatively, the outer air flow paths 50 and 54 can be in communication with a single fluid flow regulator while the middle air flow path 52 can be in communication with a separate fluid flow regulator. The fluid flow regulator, for instance, can be a pressure regulator that can control pressure. Alternatively, the fluid flow regulator can be any suitable flow meter.

The gas fed through the air flow paths 56, 58 and 60 can be air or any other suitable non-reactive gas. In one embodiment, the attenuating gas can be heated. For instance, the gas can be heated to a temperature of greater than about 80° C., such as greater than about 100° C., such as greater than about 125° C., such as greater than about 150° C., and generally less than about 400° C., such as less than about 300° C., such as less than about 200° C. The attenuating gas can be fed through each of the air flow paths 50, 52 and 54 at any suitable pressure, such as at a pressure of from about 1 psig to about 30 psig. In one embodiment, the pressure of the attenuating gas can be relatively low, such as less than about 20 psig, such as less than about 15 psig, such as less than about 10 psig, such as less than about 7 psig, such as less than about 5 psig, such as less than about 4 psig. The gas pressure is generally greater than about 1 psig, such as greater than about 2 psig.

When producing fibers using the fiber forming device 14 as shown in the figures, the avoidance of gas turbulence is generally preferred. In this regard, in one embodiment, the gas pressure or velocity of gas exiting the second air flow path 52 can generally be greater than the gas pressure or velocity of the gas exiting the air flow paths 50 and 54. It was discovered that maintaining a greater gas pressure in the middle air flow path 54 significantly reduces gas turbulence when the different gas streams converge. In one embodiment, the ratio of the gas pressure of the third air flow path 54 to the gas pressure in the first air flow path 50 and/or the second air flow path 52 is from about 1.05:1 to about 2:1, such as from about 1.08:1 to about 1.5:1, such as from about 1.1:1 to about 1.3:1. The above gas pressure ratios when operating at a pressure of from about 2 psig to about 4 psig has been found to be optimal in some embodiments.

As shown in FIG. 4, the third air flow path 54 can also include a wedge-shaped flow control device 68 that further serves to minimize turbulence. The flow control device 68 is positioned at the top of the gas nozzle, where the gas nozzle intersects with the air path 66. The wedge-shaped flow control device 68 is designed to direct gas flow towards the exit of the air flow path 54 with minimal turbulence.

Figure 5:
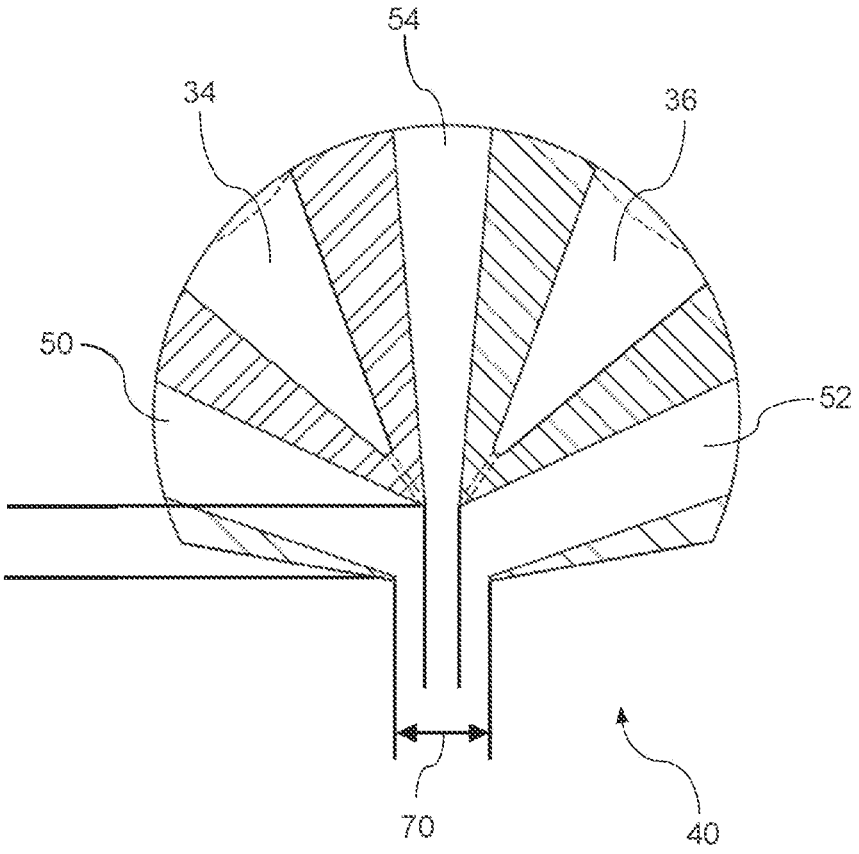
FIG. 5 is an enlarged cross-sectional view illustrating polymer nozzles and air flow paths that may be incorporated into the fiber forming device as illustrated in FIG. 2.

Referring to FIG. 5, an enlarged partial and cross-sectional view of the apex 40 of the die head 20 is shown. More particularly, FIG. 5 illustrates the relationship between the first row of polymer nozzles 34 and the second row of polymer nozzles 36 with the air flow paths 50, 52 and 54. It should be understood that the embodiment illustrated in FIG. 5 is exemplary and other arrangements of the nozzles and air flow paths are possible. In the embodiment illustrated in FIG. 5, the air flow path 50 and polymer nozzle 34 are symmetrical along a vertical axis with respect to the polymer nozzle 36 and the air flow path 52. As shown, the polymer nozzles 34 and 36 include capillary tips through which the polymer fibers are formed. In the embodiment illustrated, the exit of the polymer nozzles 34 and 36 are recessed from the apex 40 and the fiber dispensing surface of the die head 20. The polymer nozzles 34 and 36 are coterminous with the air flow path 54. The air flow paths 50 and 52 are coterminous with the apex 40.

The opening of the air flow paths 50 and 52 is generally the same distance as the recess of the polymer nozzles 34 and 36. The width or diameter of the exit of the air flow path 54 can generally be smaller than the exit of the air flow paths 50 and 52, in one embodiment. The fiber dispensing surface also defines an opening 70 through which the fibers are directed.

The air flow paths 50, 52 and 54 can define openings having any suitable shape sufficient to provide attenuating gas to the fibers being formed. In one embodiment, for instance, the air flow paths 50, 52 and 54 can comprise slots or channels that extend along the length of the die head 20. Alternatively, the air flow paths can mimic the flow paths 62, 64 and 66 as shown in FIG. 3 and comprise a row of apertures that are aligned with the rows of polymer nozzles. The apertures can be circular as shown in FIG. 3 or can have different shapes. For instance, the apertures can be slits and can have a length that extends to surround one or more of the polymer nozzles.

Figure 6:
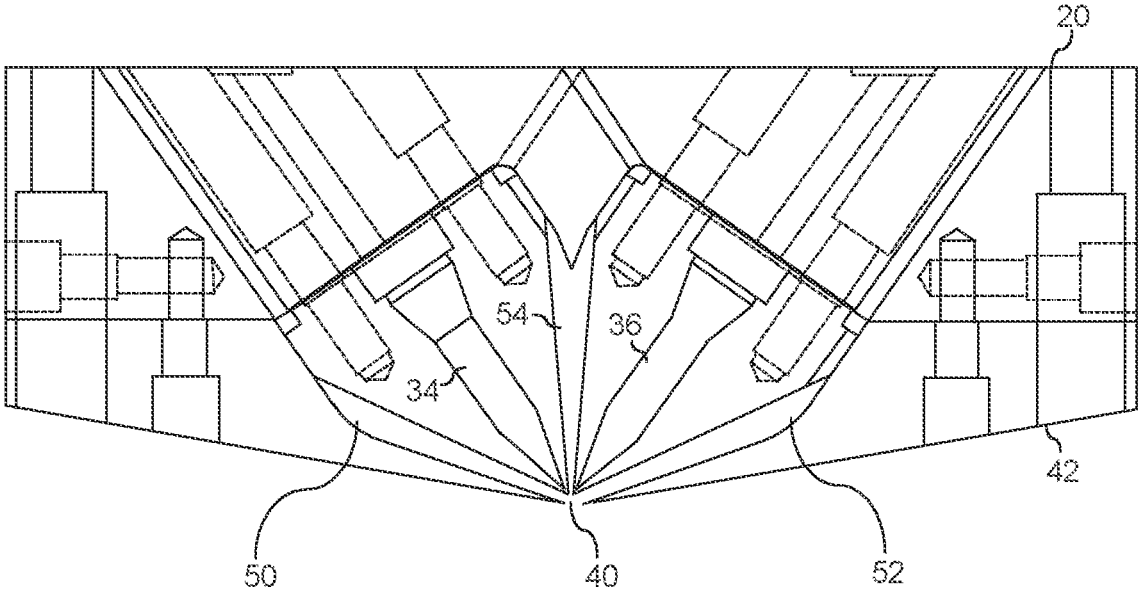
FIG. 6 is a cross-sectional view of the die head illustrated in FIG. 3.

Referring to FIG. 6, the relationship of the polymer nozzles 34 and 36 to a vertical axis of the die head 20 is shown. As described above, the polymer nozzles 34 and 36 can be placed at an angle so that the nozzles face each other and also are pointed towards the apex 40 of the fiber dispensing surface 42. Similar to the polymer nozzles 34 and 36, the first and second air flow paths 50 and 52 are also aligned with each other at an angle that is relative to a horizontal axis of the die head 20. The air flow paths 50 and 52 are angled to face each other and to emit gas streams through the opening positioned at the apex 40.

In the embodiment described above, the die head 20 includes a first row of polymer nozzles and a second row of polymer nozzles. In alternative embodiments, the die head 20 can include more than two rows of polymer nozzles combined with one or more additional air flow paths.

Figure 7:
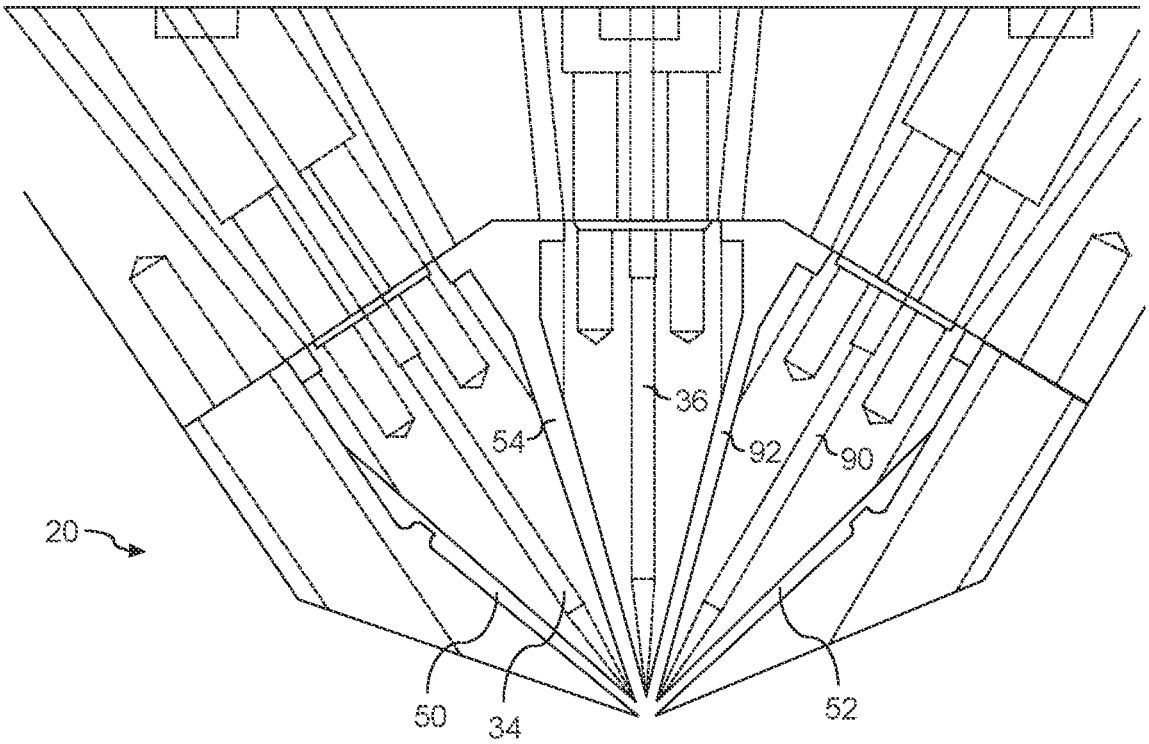
FIG. 7 is a cross-sectional view of another embodiment of a fiber forming device in accordance with the present disclosure.

For example, referring to FIG. 7, another embodiment of a die head 20 is illustrated in accordance with the present disclosure. Like reference numerals have been used to represent like elements. As shown in FIG. 7, the die head 20 includes three rows of polymer nozzles, namely a first row of polymer nozzles 34, a second row of polymer nozzles 36, and a third row of polymer nozzles 90. The first row of polymer nozzles 34 is positioned adjacent to a first air flow path 50. The third row of polymer nozzles 90 is positioned adjacent to a second air flow path 52. A third air flow path 54 is positioned between the first row of polymer nozzles 34 and the second row of polymer nozzles 36. In the embodiment shown in FIG. 7, the die head 20 further includes a fourth air flow path 92 positioned between the second row of polymer nozzles 36 and the third row of polymer nozzles 90.

The polymer material used to form fibers and nonwoven webs in accordance with the present disclosure can vary. In general, any suitable thermoplastic polymer may be used. In one embodiment, the polymer material may be a polyolefin polymer, such as a polypropylene polymer or a polyethylene polymer.

In an alternative embodiment, a polyester polymer may be used. The polyester polymer, for instance, can be bio-based and/or can be biodegradable. Any of a variety of polyesters may generally be employed, such as aliphatic polyesters, such as polycaprolactone, polyesteramides, polylactic acid (PLA) and its copolymers, polyglycolic acid, polyalkylene carbonates (e.g., polyethylene carbonate), poly-3-hydroxybutyrate (PHB), poly-3-hydroxyvalerate (PHV), poly-3-hydroxybutyrate-co-4-hydroxybutyrate, poly-3-hydroxybutyrate-co-3-hydroxyvalerate copolymers (PHBV), poly-3-hydroxybutyrate-co-3-hydroxyhexanoate, poly-3-hydroxybutyrate-co-3-hydroxyoctanoate, poly-3-hydroxybutyrate-co-3-hydroxydecanoate, poly-3-hydroxybutyrate-co-3-hydroxyoctadecanoate, and succinate-based aliphatic polymers (e.g., polybutylene succinate, polybutylene succinate adipate, polyethylene succinate, etc.); aliphatic-aromatic copolyesters (e.g., polybutylene adipate terephthalate, polyethylene adipate terephthalate, polyethylene adipate isophthalate, polybutylene adipate isophthalate, etc.); aromatic polyesters (e.g., polyethylene terephthalate, polybutylene terephthalate, etc.); and so forth.

One particularly suitable polyester is polylactic acid, which may generally be derived from monomer units of any isomer of lactic acid, such as levorotory-lactic acid ("L-lactic acid"), dextrorotatory-lactic acid ("D-lactic acid"), meso-lactic acid, or mixtures thereof. Monomer units may also be formed from anhydrides of any isomer of lactic acid, including L-lactide, D-lactide, meso-lactide, or mixtures thereof. Cyclic dimers of such lactic acids and/or lactides may also be employed. Any known polymerization method, such as polycondensation or ring-opening polymerization, may be used to polymerize lactic acid. A small amount of a chain-extending agent (e.g., a diisocyanate compound, an epoxy compound or an acid anhydride) may also be employed. The polylactic acid may be a homopolymer or a copolymer, such as one that contains monomer units derived from L-lactic acid and monomer units derived from D-lactic acid. Although not required, the content of one of the monomer units derived from L-lactic acid and the monomer unit derived from D-lactic acid is preferably about 85 mol % or more, in some embodiments about 90 mol % or more, and in some embodiments, about 95 mol % or more. Multiple polylactic acids, each having a different ratio between the monomer unit derived from L-lactic acid and the monomer unit derived from D-lactic acid, may be blended at an arbitrary percentage. Of course, polylactic acid may also be blended with other types of polymers (e.g., polyolefins, polyesters, etc.).

In one particular embodiment, the polylactic acid has the following general structure:

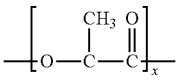

The polylactic acid can have a number average molecular weight ("$M_n$") ranging from about 40,000 to about 180,000 grams per mol, in some embodiments from about 50,000 to about 160,000 grams per mol, and in some embodiments, from about 80,000 to about 120,000 grams per mol. Likewise, the polymer also typically has a weight average molecular weight ("$M_w$") ranging from about 80,000 to about 250,000 grams per mol, in some embodiments from about 100,000 to about 200,000 grams per mol, and in some embodiments, from about 110,000 to about 160,000 grams per mol. The ratio of the weight average molecular weight to the number average molecular weight ("$M_w/M_n$"), i.e., the "polydispersity index", is also relatively low. For example, the polydispersity index typically ranges from about 1.0 to about 3.0, in some embodiments from about 1.1 to about 2.0, and in some embodiments, from about 1.2 to about 1.8. The weight and number average molecular weights may be determined by methods known to those skilled in the art.

The above polymers can be used to form monocomponent fibers, bicomponent fibers, or multicomponent fibers. In order to form bicomponent fibers, for example, two different molten polymer streams can be fed to each polymer nozzle to form the fibers. The two different polymers can be in a side-to-side arrangement or in a core and sheath arrangement.

As described above, the fiber forming device 14 of the present disclosure is particularly well suited to producing meltblown webs. In one embodiment, during formation of the webs, an absorbent material can be blown into the molten fibers as they are deposited onto the forming surface. The absorbent material, for instance, can be superabsorbent particles, cellulosic materials, or the like. Cellulosic materials that may be used include pulp fibers, such as softwood fibers and/or hardwood fibers. Contacting absorbent materials with the fibers during formation produces a web that has liquid absorbent properties.

Nonwoven webs made according to the present disclosure can have any suitable basis weight. The webs, for instance, can have a basis weight of from about 3 gsm to about 40 gsm. In one embodiment, relatively lightweight webs are formed having a basis weight of less than about 15 gsm, such as less than about 10 gsm, such as less than about 8 gsm.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed:

1. A fiber forming device comprising:

a die head having a length and a width, the die head comprising a first row of polymer nozzles spaced from and substantially parallel with at least a second row of polymer nozzles, the first row and the second row of polymer nozzles being configured to receive a flow of molten polymer material for emitting polymer fibers from the die head, the first and second rows of polymer nozzles extending along the length of the die head;

a first air flow path, a second air flow path, and a third air flow path that are spaced apart and extend along the length of the die head in a parallel relationship, the first air flow path being positioned between a first outer edge of the die head and the first row of polymer nozzles, the second air flow path being positioned between a second outer edge of the die head and the second row of polymer nozzles, the third air flow path being positioned between the first row of polymer nozzles and the second row of polymer nozzles, the first air flow path including a first outlet that is positioned such that a gas stream flowing out of the first outlet converges with a gas stream exiting the third air flow path, the second air flow path including a second outlet that is positioned such that a gas stream flowing out of the second outlet converges with a gas stream exiting the third air flow path, the first air flow path, the second air flow path, and the third air flow path all being configured to direct attenuating gas streams against molten polymer fibers exiting the first row of polymer nozzles and the second row of polymer nozzles; and a fluid flow regulator in communication with the gas flow path to the third air flow path, the fluid flow regulator being configured to maintain gas pressure through the third air flow path above a pressure of a gas exiting the first air flow path and of a gas exiting the second air flow path, wherein the third air flow path is in communication with a gas flow path that is configured to control fluid flow to the third air flow path independently of fluid flow to the first air flow path and to the second air flow path such that a gas can be fed to the third air flow path at a different pressure than gases being fed to the first air flow path and to the second air flow path.

2. The fiber forming device as defined in claim 1, wherein the first row of polymer nozzles and the second row of polymer nozzles are each positioned at an angle towards each other.

3. The fiber forming device as defined in claim 2, wherein the die head includes a vertical axis that extends from a top of the die head to the bottom of the die head and includes a horizontal axis that is perpendicular to the vertical axis and wherein the first row of polymer nozzles are positioned at an acute angle relative to the vertical axis and the second row of polymer nozzles are positioned at an acute angle relative to the vertical axis.

4. The fiber forming device as defined in claim 1, wherein the die head includes a fiber dispensing surface, the first row of polymer nozzles and the second row of polymer nozzles being disposed along the fiber dispensing surface, similarly, the first air flow path, the second air flow path, and the third air flow path are also disposed along the fiber dispensing surface, the fiber dispensing surface having a V-shape defining an apex, and wherein the first row of polymer nozzles and the second row of polymer nozzles are positioned to emit polymer fibers adjacent to the apex of the fiber dispensing surface.

5. The fiber forming device as defined in claim 1, wherein the first air flow path and the second air flow path are each positioned at an angle towards each other.

6. The fiber forming device as defined in claim 5, wherein the die head includes a vertical axis that extends from a top of the die head to the bottom of the die head and includes a horizontal axis that is perpendicular to the vertical axis and wherein the first air flow path is positioned at an acute angle relative to the horizontal axis and the second air flow path is positioned at an acute angle relative to the horizontal axis.

7. The fiber forming device as defined in claim 1, wherein the third air flow path is positioned to emit a gas in a downward, vertical direction.

8. The fiber forming device as defined in claim 1, wherein the first air flow path and the first row of polymer nozzles are symmetrical to the second air flow path and the second row of polymer nozzles with respect to a vertical axis of the die head.

9. The fiber forming device as defined in claim 1, wherein the first and second air flow paths comprise slots that extend along the length of the die head or comprise a row of apertures that extend along the length of the die head.

10. The fiber forming device as defined in claim 1, wherein the first air flow path is in fluid communication with a first air chamber, the second air flow path is in fluid communication with a second air chamber, and the third air flow path is in fluid communication with a third air chamber, the first, second and third air chambers being isolated from each other, each of the first, second and third air chambers being in communication with a pressurized gas source for providing a pressurized gas to each of the first, second and third air flow paths.

11. The fiber forming device as defined in claim 1, wherein the third air flow path is in fluid communication with a wedge-shaped flow control device for directing flow of a gas through the third air flow path while preventing turbulence.

12. The fiber forming device as defined in claim 1, further comprising a third row of polymer nozzles and a fourth air flow path, the fourth air flow path being positioned between the second row of polymer nozzles and the third row of polymer nozzles.

* * * * *